US006484982B1

(12) United States Patent
Barry et al.

(10) Patent No.: US 6,484,982 B1
(45) Date of Patent: Nov. 26, 2002

(54) STEEL POLE STEP ASSEMBLY

(75) Inventors: William E. Barry, Brookfield, WI (US); Todd K. Knapp, Waukesha, WI (US)

(73) Assignee: Speed Systems, Inc., Brookfield, WI (US)

( * ) Notice: Subject to any disclaimer, the term of this patent is extended or adjusted under 35 U.S.C. 154(b) by 0 days.

(21) Appl. No.: 09/809,655

(22) Filed: Mar. 15, 2001

Related U.S. Application Data

(60) Provisional application No. 60/189,730, filed on Mar. 16, 2000.

(51) Int. Cl.[7] ..... E06C 9/00

(52) U.S. Cl. ..... 248/218.4; 248/220.21; 248/243; 248/231.9; 182/90; 182/92

(58) Field of Search ..... 248/218.4, 220.21, 248/224.8, 231.9, 243; 182/90, 91, 92

(56) References Cited

U.S. PATENT DOCUMENTS

| | | | | |
|---|---|---|---|---|
| 459,844 A | | 9/1891 | Thomas | |
| 480,977 A | | 8/1892 | Thomas | |
| 1,140,940 A | * | 5/1915 | Bales | 248/243 |
| 1,211,992 A | | 1/1917 | Winter | |
| 1,419,563 A | | 6/1922 | Horning | |
| 3,399,746 A | | 9/1968 | Wood | |
| 3,497,033 A | | 2/1970 | Herrenkohl | |
| 3,712,418 A | * | 1/1973 | Currence, Jr. | 182/92 |
| 4,013,253 A | * | 3/1977 | Perrault et al. | 248/222.51 |
| 4,382,416 A | | 5/1983 | Kellogg-Smith | |
| 4,449,612 A | * | 5/1984 | Southard | 108/152 |
| 4,450,936 A | * | 5/1984 | Strom | 182/92 |
| 4,534,529 A | * | 8/1985 | Dorner | 248/223.41 |
| 5,941,485 A | | 8/1999 | Davidson et al. | |
| 6,269,906 B1 | * | 8/2001 | Dockter et al. | 182/92 |

FOREIGN PATENT DOCUMENTS

NZ WO 00/68541 * 11/2000

OTHER PUBLICATIONS

Lindsey Manufacturing Company, 2403 "L–Bolt" Pole Pate.
Valmont, Testing: Valmont Safety Step.
A.B. Chance Company, Steps, Pole, Nov. 1985.

* cited by examiner

*Primary Examiner*—Leslie A. Braun
*Assistant Examiner*—Deborah Brann
(74) *Attorney, Agent, or Firm*—Boyle Fredrickson Newholm Stein & Gratz S.C.

(57) ABSTRACT

A step assembly is provided that can be easily slipped into a utility pole opening and locked in place, and then easily removed after use. The step assembly includes 1) a step member having first and second legs, which are connected at one end and open at the opposite end and 2) a lever member that is rotatably attached to the step member and that urges the first and second legs apart. The free end of the legs include tabs protruding upwardly. The step assembly is inserted into the utility pole opening by pressing the legs toward each other. The step assembly is then inserted into the opening. The legs are released such that the legs spread apart and press against the opening's sides. The lever member is then rotated, forcing the enlarged portion between the legs of the step assembly to lock the step assembly in place.

21 Claims, 3 Drawing Sheets

STEEL POLE STEP ASSEMBLY

CROSS-REFERENCE TO RELATED APPLICATION

This application claims priority under 35 U.S.C. §119(e) to U.S. Provisional Patent Application No. 60/189,730, filed Mar. 16, 2000, the entirety of which is incorporated by reference herein.

FIELD OF THE INVENTION

The present invention relates to a steel pole step assembly.

BACKGROUND OF THE RELATED ART

Utility poles are commonly used to suspend telephone and electrical transmission and distribution wires in the air. The wires are usually suspended high enough so that pedestrians, cars, trucks, and other vehicles can safely pass under the wires. Utility poles have conventionally been made of wood. However, the use of steel utility poles is increasing.

Utility poles, whether wood or steel, are normally not provided with steps at least at the lower levels so as to prevent unauthorized personnel from climbing the pole. However, authorized personnel such as technicians must have a way to climb a pole. For wood poles, one method involves the use of spiked boots that enables a technician to dig a spike attached to the boot into the side of the pole so that he or she can climb the pole.

For steel poles, various types of special step devices have been proposed. For example, one type of device available from AB Chance Company, Centralia, Mo., involves an assembly that includes a cinch nut fastened to the pole and a step lug that slides over the cinch nut. The cinch nut and step lug are separate parts. The cinch nuts are normally fastened to the pole permanently. When the utility technician arrives, he or she simply places the step lugs over the cinch nuts, and removes them after the job is complete. A drawback of this device is the requirement for specific hardware, i.e., the cinch nuts, to be permanently affixed to poles. Moreover, the step can only be used with poles having the cinch nuts attached thereto.

Another type of device available from Valmont Company comprises a steel rod, bracket, and pair of nuts. The steel rod is inserted through a small opening in the side of the utility pole. The bracket is slipped over the rod and tightened against the pole with the nuts. A limitation of this device is that it requires a technician using the device to have a wrench whenever the technician is installing or removing the step. If not, the technician must climb back down the pole to retrieve the wrench. Furthermore, the cinch nuts may require retightening and, when the nuts are over-tightened, the step displays ductile behavior.

SUMMARY OF THE INVENTION

The invention, which is defined by the claims set out at the end of this disclosure, is intended to solve at least some of the problems noted above. A step assembly is provided that can be easily slipped into an opening in the side of the utility pole and locked in place, and then easily removed after use.

In a preferred embodiment of the invention, the step assembly includes a step member having first and second legs, which are connected at one end and open at the opposite end. The legs are configured to be insertable into an opening in a utility pole and include tabs protruding upwardly from the legs at their open ends. The tabs engage an inner surface of the pole and help retain the step assembly in place. The step assembly also includes a lever member that is rotatably attached to the step member. The lever member includes an enlarged portion that can be forced between the legs to urge the legs apart and lock the step assembly in place.

The step assembly is inserted into the opening in the utility pole by pressing the legs of the step assembly toward each other at the free end. The free end of the step member is then inserted into the opening in the utility pole. The legs of the step assembly are released such that the legs spread apart and press against the sides of the opening. The lever member is then rotated such that the enlarged portion is forced between the legs of the step assembly to lock the step assembly in place.

BRIEF DESCRIPTION OF THE DRAWINGS

Preferred exemplary embodiments of the invention are illustrated in the accompanying drawings, in which like reference numerals represent like parts throughout.

Figure 1:
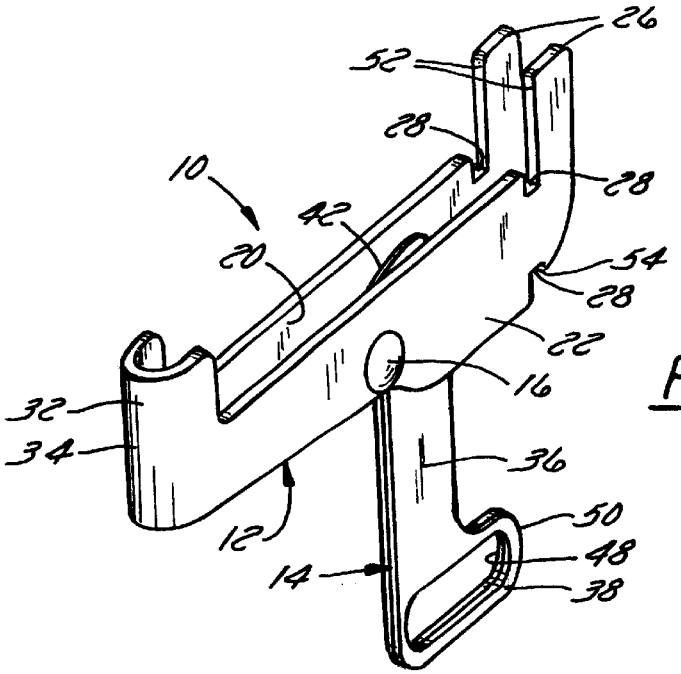
FIG. 1 is a perspective side view of a steel pole step assembly of the present invention.
Figure 2:
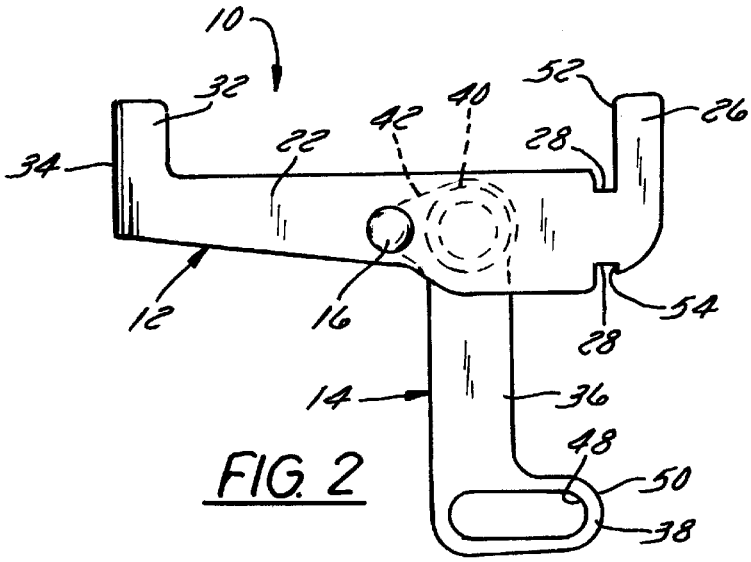
FIG. 2 is a side view of the steel pole step assembly with the internal components shown in phantom view.
Figure 3:
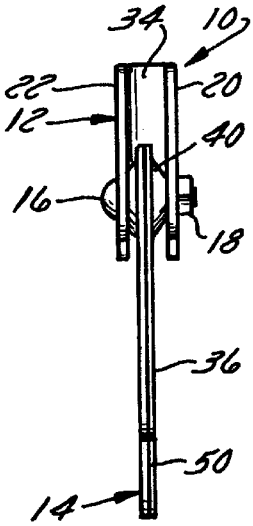
FIG. 3 is a front view of the steel pole step assembly.
Figure 4:
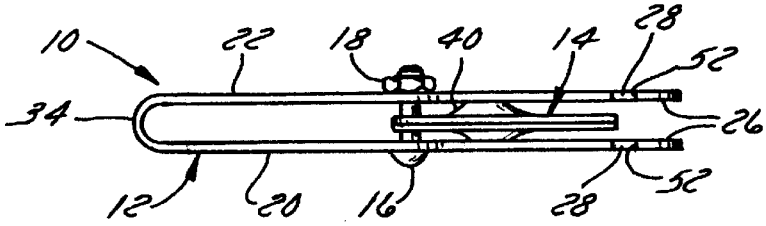
FIG. 4 is a bottom view of the steel pole step assembly.

Before explaining embodiments invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF PREFERRED EMBODIMENTS

In the drawings, a preferred embodiment of the steel pole step assembly in accordance with the invention is illustrated in FIGS. 1–4 at the reference numeral 10. The step assembly is for use with utility poles that are hollow and that have openings therein. The openings are typically round, 1⅛ inch diameter openings or rectangular openings. However, the step assembly 10 can also be used with utility poles having openings of other shapes. The preferred embodiment of the steel pole step assembly is particularly well suited for use on steel poles having openings therein.

The steel pole step assembly 10 is essentially constructed from four components, a step member 12, a lever member 14, an assembly screw 16 and a lock nut 18. The step member 12 is essentially an elongated U-shaped member forming a first leg 20 and a second leg 22 that may be squeezed together and spread apart. As illustrated particularly in FIGS. 1 and 2, at the open end of the step member, each leg has an upwardly protruding tab 26 and a set of inwardly extending slots 28, including one slot that extends downwardly and one slot that extends upwardly. The tabs 26 and slots 28 are designed so that, when the open end of the U-shaped step member 12 is squeezed together, that end may be inserted into an opening in the side of the steel utility pole.

At the other end of the step member 12 is a connector portion 32 that retains the first and second legs 20, 22 together to form a closed, U-shaped portion 34. The connector portion 32 preferably extends beyond the top of the legs 20, 22 to provide a catch, which reduces the possibility of the user's foot slipping off the end of the step member 12.

The lever member 14 is planar and generally L-shaped having a long leg 36 and a short leg 38 that extends laterally from the long leg 36. At the top of the long leg 36 is an expanded, circular, end portion 40. A protrusion 42 (FIG. 2) laterally extends from a side of the expanded portion 40 that is opposite from a side from which the short leg 38 laterally extends. The protrusion 42 has a hole (not shown) therethrough that receives the assembly screw 16. The lever member 14 is rotatably fastened to the step member 12 at a hole (not shown) in the first leg 22 by inserting the assembly screw 16 through the holes and attaching the lock nut 18 to the assembly screw 16. Alternatively, a rivet or other equivalent means for fastening the lever member 14 to the step member 12 may be used The range of motion through which the lever member 14 can rotate starts with the lever member 14 being in a position in which its long leg 36 is generally parallel to and against the legs 20, 22 of the step member 12 and ends with a position in which the long leg 36 is generally perpendicular to the legs 20, 24. When the lever member is in the generally parallel position, the expanded portion 40 is retracted away from the legs 20, 22 so that the legs 20, 22 can be squeezed together.

When the lever member 14 is rotated into the generally perpendicular position, the lever member 14 becomes locked into place by virtue of the expanded portion 40 of the lever member 14 being forced in between the first and second legs 20, 22. In the perpendicular position, the expanded portion 40 of the lever member 14 is forced between the first and second legs 20, 22. The expanded portion 40 urges the first and second legs 20, 22, including the tabs 26, away from each other at the open end of the step member 12. When the lever member 12 is in the perpendicular position, the legs 20, 22 cannot be squeezed together because the expanded portion 40 hinders their movement.

Figure 6:
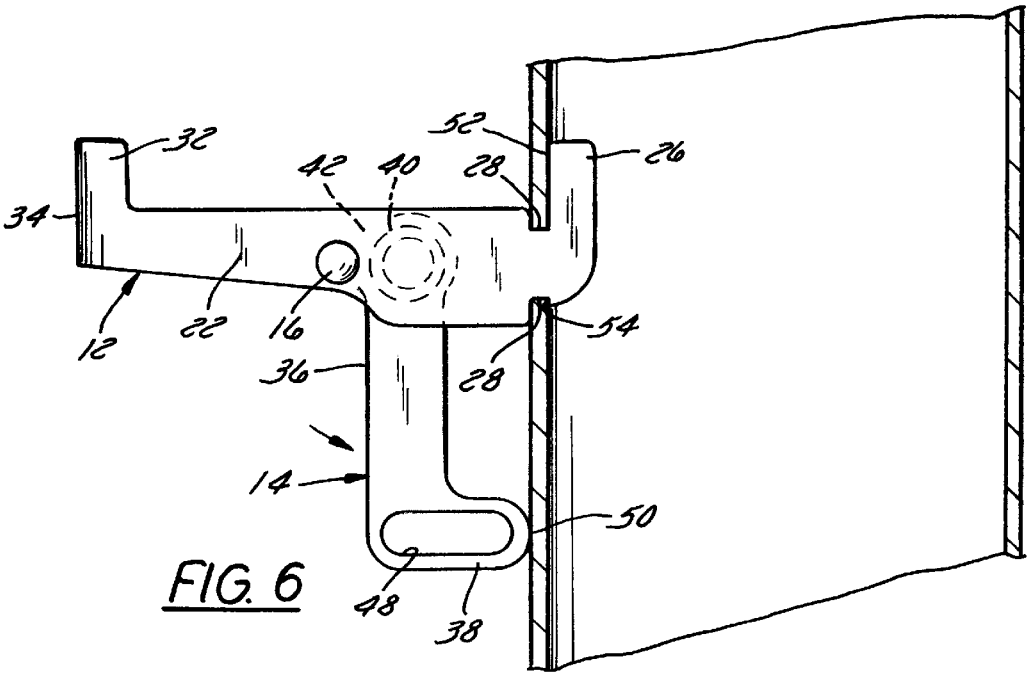
FIG. 6 is a side view of the step assembly after it has been inserted into the opening in the utility pole.

Short leg 38 of the lever member 14 preferably includes an elongated opening 48 therethrough to provide a structure for a user to easily insert one or more fingers to grasp the short leg 38 to assist in rotating the lever member 14. The short leg 38 has a length such that when it is rotated away from the first and second legs 20, 22 of the step member 12 and into the generally perpendicular, locked position, an end 50 of the short leg 38 abuts against an outer surface of the pole to assure that the expanded portion 40 is not rotated too far but that it is in the proper position between the two legs 20, 22. Additionally, when the lever member is rotated downward position and the end 50 of short leg 38 abuts against the surface of the pole as shown in FIG. 6, there is a space between the long leg 36 of the lever member 14 and surface of the pole. When removing the assembly, the user is able to put his or her fingers either into opening 48 or into the space between the pole and long leg 36 in order to rotate the lever member upwards.

Figure 5:
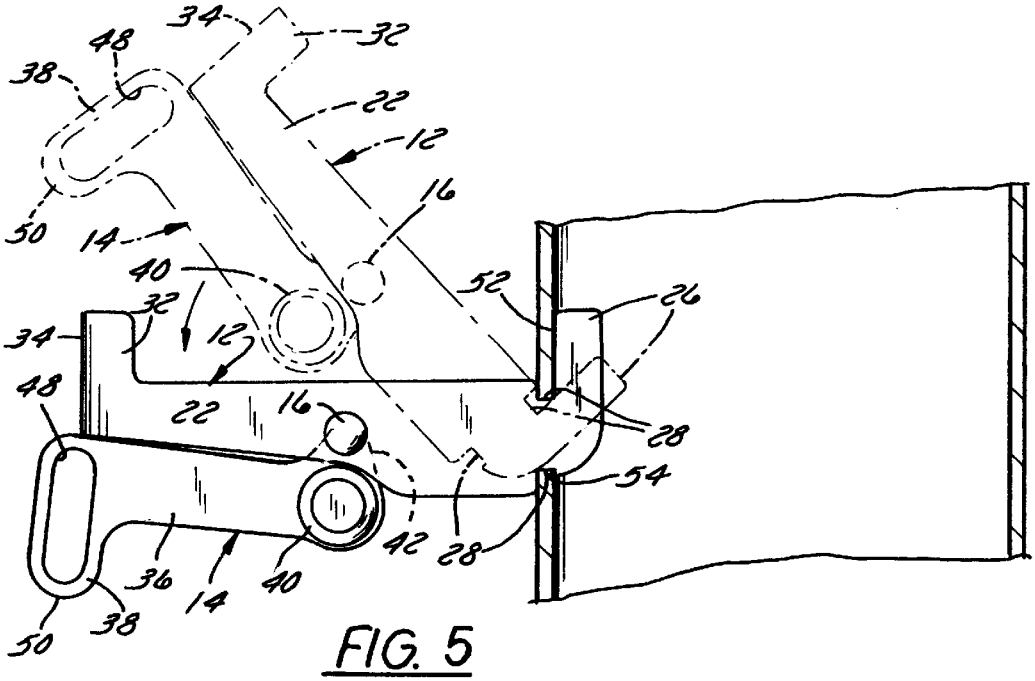
FIG. 5 is a side view of the step assembly showing it in two different positions as it is being inserted into an opening of a steel utility pole. A first position is shown in phantom, and a second position is shown in solid line.

Referring to FIGS. 5 and 6, when inserted inside the utility pole, upper and lower interior edges 52 and 54 of the tabs 26 rest against the pole at two, spaced-apart locations. The curvature of the pole holds the tabs 26 and rest of the step assembly 10 in place. Thus, even though the opening is, for example, round, the step assembly 10 will not move once it is inserted into the opening and the expanded portion 40 of the lever member 14 is forced between the first and second legs 20, 22.

Figure 7:
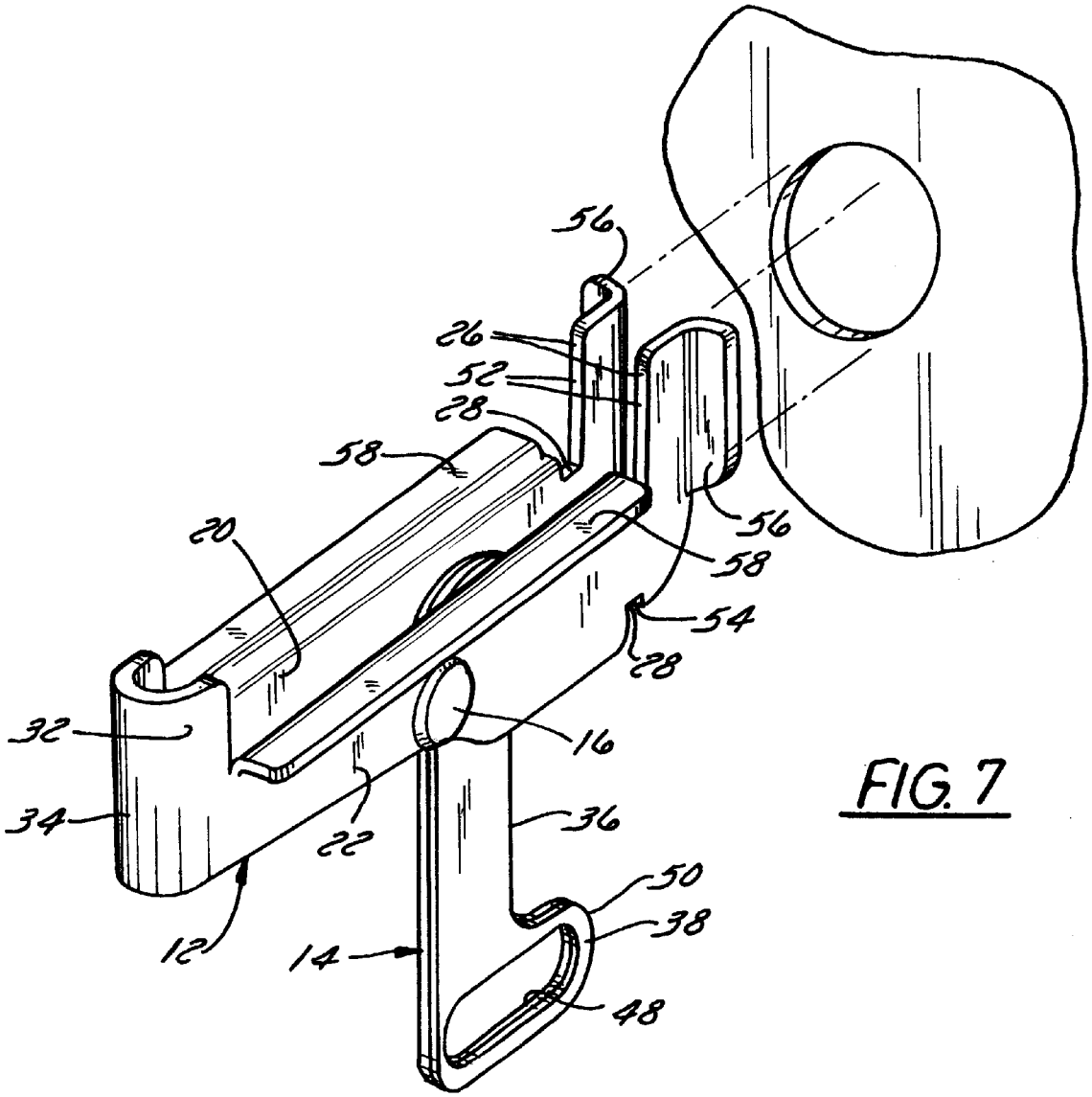
FIG. 7 is a perspective view of the step assembly showing the step assembly in alignment with the opening in the utility pole.

Now referring to FIG. 7, the step assembly 10 may include flanges 56 that extend laterally outwardly from the protruding tabs 26 of the open end of the step member 12. The flanges 56 strengthen the protruding tabs 26 and help guide the tabs 26 into the opening in the utility pole. The step assembly 10 may also include flanges 58 that extend laterally outwardly from an upper surface of the first and second legs 20, 22 of the step member 12. The flanges 58 provide a larger surface area on which a user's foot is placed, thereby providing greater stability to the user. The flanges 58 also add greater strength to the legs 20, 22, due to the bend of the metal.

Figure 8:
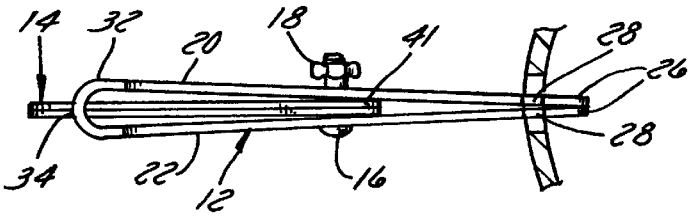
FIG. 8 is a top view of the step assembly.

In use and operation, the steel pole step assembly 10 disclosed herein is installed onto a steel utility pole in essentially the following manner. Referring back to FIG. 5, the lever member 14 is first placed into the unlocked, parallel position by rotating the long leg 36 toward the closed, U-shaped portion 34 of the step member 12. The user then squeezes the open ends of the step member 12 so that the two legs 20, 22 come together as is shown in FIG. 8. Referring now to the phantom lines of FIG. 5, the open end of the step member 12 is then tilted and the tabs 26 are inserted through the opening and into the interior of the hollow cylindrical utility pole. The step assembly 10 is then tilted downwardly as is shown in the solid lines of FIG. 5 so that the slots 28 on step member 12 become engaged into the walls of the metal pole with the upper slots 28 engaging an upper portion of the opening and the lower slots 28 engaging a lower portion of the opening. The user then releases the pressure on the open ends of the step member 12. With the release of pressure, the two legs 20, 26 of the step assembly 10 spread apart to engage vertical portions of the utility pole opening. The step assembly is thereby placed in a position so that the upper surface of the step member 12 protrudes perpendicularly outward from the side of the utility pole.

The step assembly 10 is locked into place by rotating the long leg 36 of the lever member 14 downward until the end 50 of the short leg 38 abuts against the outer wall of the pole. In the perpendicular position, the expanded portion 40 of the lever member 14 is forced in between the first and second legs 20, 22 of the step member 12. When this occurs, the open ends of the first and second legs 20, 22 of the step member 12 are spread apart so that the tabs 26 are effectively locked into the interior of the pole. The combination of spreading the open end of the step member 12 apart, in cooperation with the circumference of the cylindrical pole, both locks the step assembly 10 in place and prevents it from rotating or becoming loose. Multiple step assemblies 10 can be used to climb the utility pole.

The step assembly 10 may be removed by rotating the long leg 36 of the lever member 14 away from the pole and into the parallel position so that the expanded portion 40 is again retracted away from the legs 20, 22 of the step member 12 as is shown in FIG 5. The open ends of the member 12 are squeezed together, and the step assembly 10 is lifted and tipped out of the opening as is shown in the phantom lines of FIG. 5. This quickly and easily removes the step assembly 10 from the pole such that it can be used in another opening or it can be completely removed from the pole and used at a different location.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. For example, the step assembly can be used with poles made from other non-wood materials such as ceramics, plastics, fiberglass and other materials. Additionally, the step assembly can be used on structures other than poles. Such structures include, but are not limited to, planar structures such as walls.

The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A step assembly for use on a non-wooden utility pole, the step assembly comprising:

(A) a step member which is configured to be insertable into an opening in a utility pole and engagable therein;

(B) a lever mechanism which is rotatably attached to the step member and which locks the step assembly in place after it is inserted into the opening;

wherein the step member comprises a U-shaped member whose free ends are insertable into the opening in the utility pole.

2. A step assembly of claim 1, wherein each free end of the U-shaped member includes a tab upwardly protruding therefrom and slots extending inwardly therefrom, and wherein the tabs are configured to be engageable on the inner surface of the utility pole and the slots are configured to be engageable against a portion of the opening of the utility pole.

3. A step assembly of claim 1, wherein the lever mechanism includes an enlarged portion that can be forced inside of the U-shaped member to urge the free ends of the U-shaped member apart.

4. A step assembly for use on a non-wooden utility pole, the step assembly comprising:

(A) a step member including a first and second leg, the legs being connected at one end, the opposite end not being connected and being configured to be insertable into an opening in a utility pole; and (B) a lever member that is rotatably attached to the step member and, when rotated, urges the first and second legs apart.

5. A step assembly of claim 4, wherein each leg includes an upwardly protruding tab and a set of inwardly extending slots.

6. A step assembly of claim 5, further comprising flanges that extend laterally outwardly from the protruding tabs of the non-closed end of the step member.

7. A step assembly of claim 5, wherein the protruding tabs are configured to fit into a round opening on the utility pole.

8. A step assembly of claim 5, wherein the protruding tabs are configured to fit into a rectangular slot on the utility pole.

9. A step assembly of claim 4, wherein the lever member is generally L-shaped and includes:

(A) a long leg, (B) a short leg that extends laterally from the long leg at an end, and (C) an expanded end an opposite end, wherein the expanded area urges the first and second legs of the step member apart.

10. A step assembly of claim 9, further comprising a finger opening disposed in the short leg.

11. A step assembly of claim 9, wherein the short leg has a length such that when the lever member is rotated, the end opposite the long leg can engage an outer surface of the utility pole.

12. A step assembly of claim 11, further comprising flanges that extend laterally outwardly from an upper surface of the first and second legs of the step member.

13. A step assembly for use on a non-wooden utility pole, the step assembly comprising:

(A) a step member including (i) a first and second leg, (ii) a connector that connects the first and second legs on a first end of each leg, the second end of each leg being open, (iii) a tab that protrudes upwardly from each leg at the open end, and (iv) a set of slots that extend inwardly from each leg at its open end, wherein the tabs and slots are configured such that, when the open end of the step member is squeezed together, that end may be inserted into an opening in a side of the utility pole; and (B) a lever member that is configured to be insertable between the legs of the step member and, when inserted, urges the first and second legs apart from each other.

14. A step assembly of claim 14, wherein the lever member comprises:

(i) a generally L-shaped portion, which is rotatably connected to the step member, and (ii) an expanded portion, which can be forced in between the first and second legs of the step member to expand the first and second legs apart.

15. A step assembly of claim 14, wherein the generally L-shaped portion includes an elongated hole therethrough, the hole being configured to accept at least one finger of a user.

16. A step assembly of claim 14, wherein the generally L-shaped portion includes a long leg and a short leg, the short leg having a length such that, when in use, when it is rotated away from the first and second legs of the step member, a terminal end of the short leg abuts against the utility pole when the step assembly is in use.

17. A method comprising:

(A) inserting a step assembly into an opening in a utility pole;

(B) engaging the step assembly against at least a portion of the opening of the utility pole and against an inner surface of the utility pole; and (C) locking the step assembly in place;

wherein the step assembly comprises a U-shaped member and wherein the inserting comprises inserting free ends of the U-shaped member into the opening; and wherein the step assemble further comprises a rotatably attached lever member having an enlarged portion and wherein the locking comprises forcing the enlarged portion of the lever member inside of the U-shaped member to urge the free ends of the U-shaped member apart.

18. A method of claim 17, wherein the step assembly comprises a U-shaped member includes a tab protruding therefrom and slots extending inwardly therefrom, and therein the engaging comprises engaging the taps on the inner surface of the utility pole and engaging the slots against the portion of the opening of the utility pole.

19. A method of claim 17, further comprising:

(A) unlocking the step assembly;

(B) lifting and tilting the step assembly; and (C) removing the step assembly from the opening.

20. A method comprising:

(A) providing a step assembly for use on a non-wooden utility pole including (i) a step member including a first and second leg, the legs being connected at one end, the opposite end being free and being configured to be insertable into an opening in a utility pole, wherein each leg at its free end includes a tab protruding upwardly therefrom and slots extending inwardly therefrom, and (ii) a lever member that is rotatably attached to the step member and that includes an enlarged portion;

(B) pressing the legs of the step member toward each other at the free end;

(C) inserting the free end of the step member into the opening in a utility pole;

(D) releasing the legs of the step assembly such that the legs press against the sides of the opening; and (E) rotating the lever member such that the enlarged portion is forced between the legs of the step assembly.

21. A method of claim 20,further comprising:

(A) rotating the lever member in a direction that is opposite to the direction of rotation of step (E) such that the enlarged portion is removed from the legs of the step assembly;

(B) lifting and tilting the step assembly; and (C) removing the step assembly from the opening.

* * * * *